US006003710A

United States Patent [19]

Huang

[11] Patent Number: 6,003,710

[45] **Date of Patent: *Dec. 21, 1999**

[54] COVER STRUCTURE WITH INTEGRAL UTENSIL MEANS FOR CANNED AND CUPPED FOOD

[76] Inventor: Shou Li Huang, 9-1 Fl., No. 80, Sec. 2, Chang-An E. Rd., Taipei, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 08/820,678

[22] Filed: Mar. 18, 1997

[51] Int. Cl.[6] ..... B65D 41/56

[52] U.S. Cl. ..... 220/212; 220/521; 220/735; 215/228; 215/391; 215/DIG. 5

[58] Field of Search ..... 220/212, 521, 220/735, 574.1; 215/228, 390, 391, DIG. 5

[56] References Cited

U.S. PATENT DOCUMENTS

| | | | |
|---|---|---|---|
| D. 309,845 | 8/1990 | Pozzi . | |
| 1,607,864 | 11/1926 | Butler | 220/735 X |
| 1,625,335 | 4/1927 | Schneider . | |
| 1,657,325 | 1/1928 | Suttle . | |
| 1,749,658 | 3/1930 | Ault . | |
| 1,834,085 | 12/1931 | Bloom . | |
| 2,175,735 | 10/1939 | Banks . | |
| 2,433,926 | 1/1948 | Sayre . | |
| 2,789,608 | 4/1957 | Tupper . | |
| 3,208,625 | 9/1965 | Trabacchi . | |
| 3,334,778 | 8/1967 | Saunders . | |
| 3,381,876 | 5/1968 | Biggins . | |
| 3,428,099 | 2/1969 | Tenenouser . | |
| 3,550,805 | 12/1970 | Leonforte . | |
| 3,623,632 | 11/1971 | Chang . | |
| 3,624,787 | 11/1971 | Newman | 220/212 |
| 3,679,093 | 7/1972 | Chang . | |
| 3,704,779 | 12/1972 | Nigg . | |
| 3,722,779 | 3/1973 | Chang . | |
| 3,730,372 | 5/1973 | Komendowski . | |
| 3,874,554 | 4/1975 | Chang | 220/212 X |
| 3,925,890 | 12/1975 | Frodsham . | |
| 3,931,925 | 1/1976 | Ruff . | |
| 3,955,742 | 5/1976 | Marshall et al. . | |
| 4,036,398 | 7/1977 | Hoogvelt et al. . | |
| 4,060,176 | 11/1977 | Tobiasson . | |
| 4,216,875 | 8/1980 | Stanish . | |
| 4,218,010 | 8/1980 | Ruff . | |
| 4,589,204 | 5/1986 | Vogel . | |
| 4,615,120 | 10/1986 | Newman . | |
| 4,930,637 | 6/1990 | DeRoseau . | |
| 5,090,572 | 2/1992 | DeRoseau . | |
| 5,174,452 | 12/1992 | Wang | 206/542 |
| 5,188,234 | 2/1993 | Fukuda et al. . | |
| 5,197,623 | 3/1993 | Wang | 220/212 |
| 5,222,622 | 6/1993 | Laske, Jr. . | |
| 5,251,758 | 10/1993 | Kolacek . | |
| 5,251,774 | 10/1993 | Engle . | |
| 5,415,309 | 5/1995 | Wang . | |
| 5,443,174 | 8/1995 | Bauer | 220/212 |
| 5,491,897 | 2/1996 | Michelena . | |
| 5,705,212 | 1/1998 | Atkinson . | |

FOREIGN PATENT DOCUMENTS

| | | |
|---|---|---|
| 59647 | 6/1918 | Austria . |
| 112144 | 9/1899 | Germany . |
| 665 943 A5 | 6/1988 | Switzerland . |

*Primary Examiner*—Stephen Cronin
*Attorney, Agent, or Firm*—Bacon & Thomas

[57] ABSTRACT

A cover including a cover body adapted for covering on a top end of a canned food or cupped food, a kitchen utensil integrally formed in said cover body and connected thereto by separated connecting points, and a sealing film sealed on an outer side of the cover body to protect the kitchen utensil from contamination when the cover body is covered on a canned food or cupped food, the kitchen utensil including a utensil body having a coupling neck with transverse coupling notches, and a utensil handle having a coupling neck with upright coupling rods adapted for coupling to the coupling neck of the utensil body.

1 Claim, 5 Drawing Sheets

COVER STRUCTURE WITH INTEGRAL UTENSIL MEANS FOR CANNED AND CUPPED FOOD

BACKGROUND OF THE INVENTION

The present invention relates to a cover structure for canned and cupped food, and more particularly to such a cover structure which has a kitchen utensil integrally formed therein and a sealing film sealed on one side to protect the kitchen utensil against contamination.

Using a sealed container to preserve food for a length of time is a well known technique. Commercially available canned food and cupped food are applications of this technique. Regular canned food and cupped food may contain solid foodstuffs. When eating a canned food containing solid foodstuffs, a particular kitchen utensil may be required. Conventional canned food and cupped food are not equipped with kitchen utensil means for picking up food. There are certain canned food equipped with a disposable kitchen utensil for picking up food. However, because the disposable kitchen utensil is directly put in the inside of the sealed can, it tends to be contaminated during the packing procedure of the canned food. Further, when the consumer picks up the disposable kitchen utensil from the can, the food may be contaminated by the fingers.

SUMMARY OF THE INVENTION

The present invention has been accomplished to provide a cover structure for canned food or cupped food which eliminates the aforesaid problems. It is one object of the present invention to provide a cover for canned food or cupped food which comprises a kitchen utensil integrally formed therein, that can be easily detached from the body of the cover for use. It is another object aspect of the present invention to provide a cover for canned food or cupped food which comprises a close-fitting cover body adapted for covering on a top end of a canned food or cupped food, and a kitchen utensil integrally formed in the cover body that can easily be detached from the cover body for use. It is still another aspect of the present invention to provide a cover for canned food and cupped food which comprises a close-fitting cover body adapted for covering on a canned food or cupped food, a kitchen utensil integrally formed in the cover body, and a sealing film sealed on one side of the cover body to protect the kitchen utensil against contamination.

DETAILED DESCRIPTION OF THE PREFERRED EMBODIMENT

Figure 1:
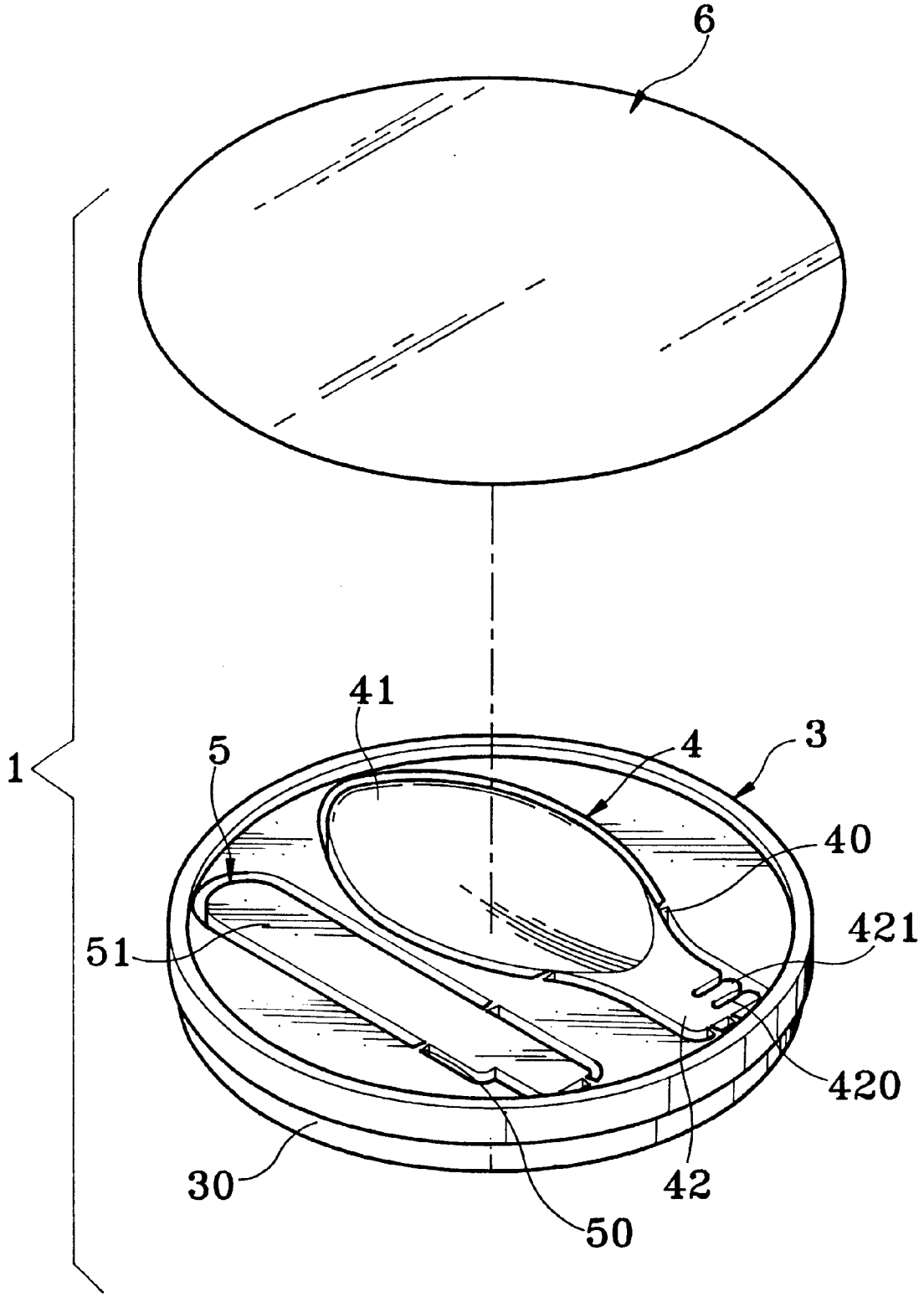
FIG. 1 shows an exploded view of a cover for canned and cupped food according to the present invention.

Referring to FIG. 1, a cover 1 in accordance with the present invention comprises generally a cover body 3 adapted for covering on a canned food 2 (see FIG. 2) or a cupped food 9 (see FIG. 6) at the top, a spoon bowl 4 and a spoon handle 5 integrally molded in the cover body 3, and a sealing film 6 sealed on the cover body 3 to protect the spoon bowl 4 and the spoon handle 5 against contamination.

Figure 2:
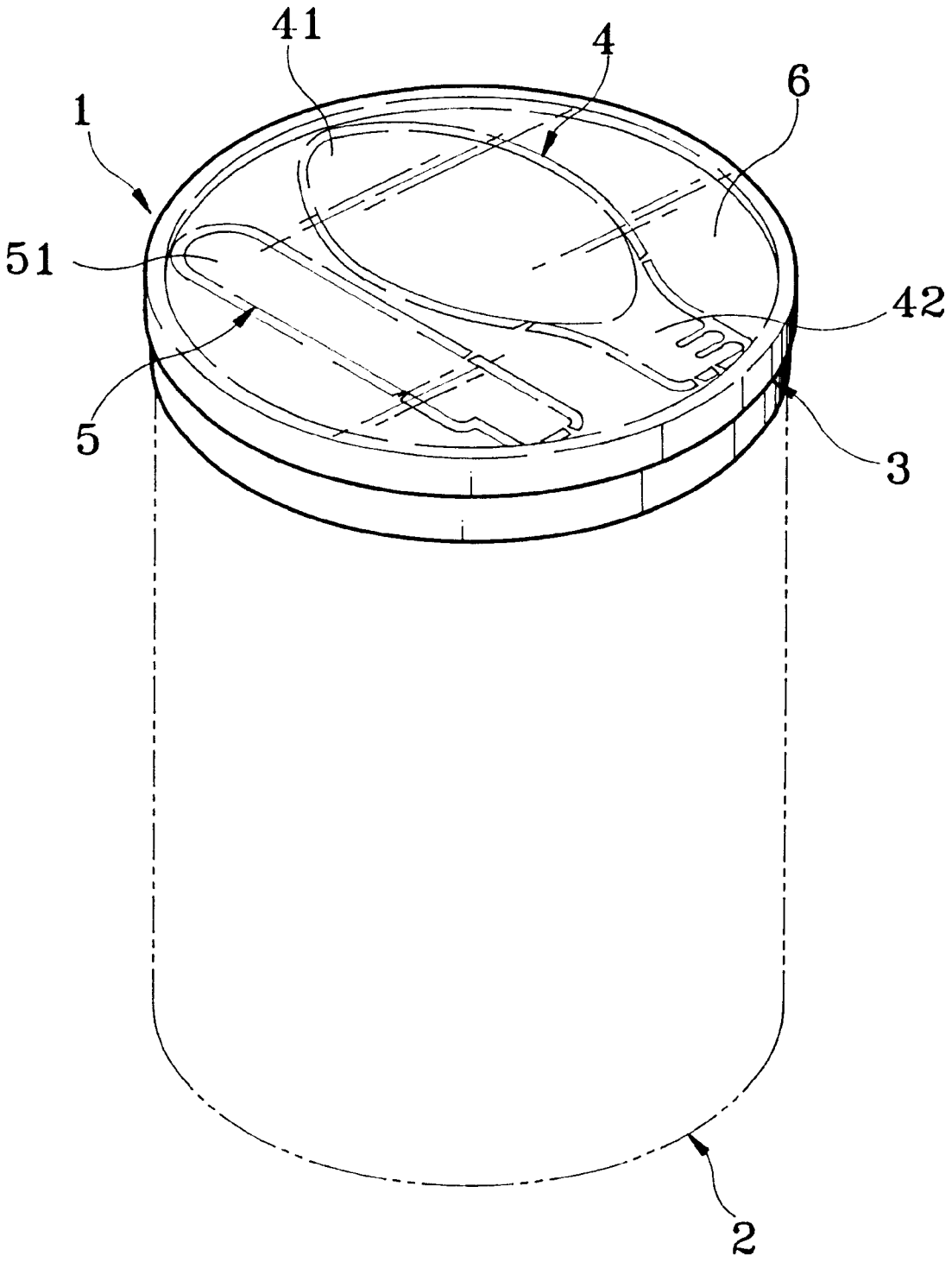
FIG. 2 is an applied view of the present invention, showing the cover on a food can.
Figure 6:
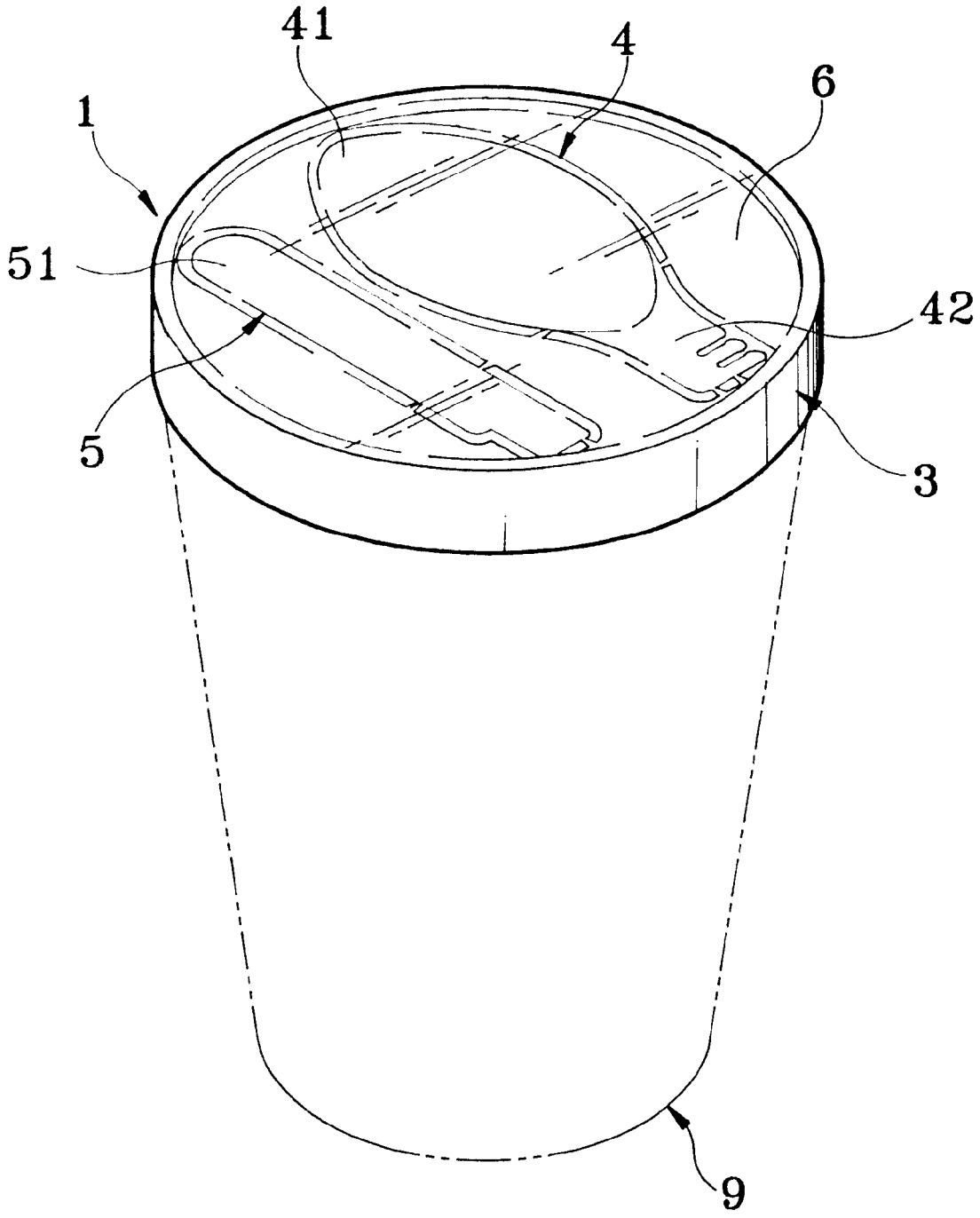
FIG. 6 is another applied view of the present invention, showing the covered cover on a food cup.

The aforesaid cover body 3 is molded from flexible material, preferably flexible plastic material, having a coupling portion 30 close-fitting into or over one end, namely, the top end of the canned food 2 (see FIG. 2) or cupped food 9 (see FIG. 6). In FIG. 2, the canned food 2 is a barrel-like container; the coupling portion 30 of the cover body 3 is a downward annular flange covered over the periphery of the top end of the canned food 2. The aforesaid spoon bowl 4 and the spoon handle 5 are respectively connected to the cover body 3 by connecting points 40;50 which can be broken by force, enabling the spoon bowl 4 and the spoon handle 5 to be easily detached from the cover body 3 for use.

Figure 3A:
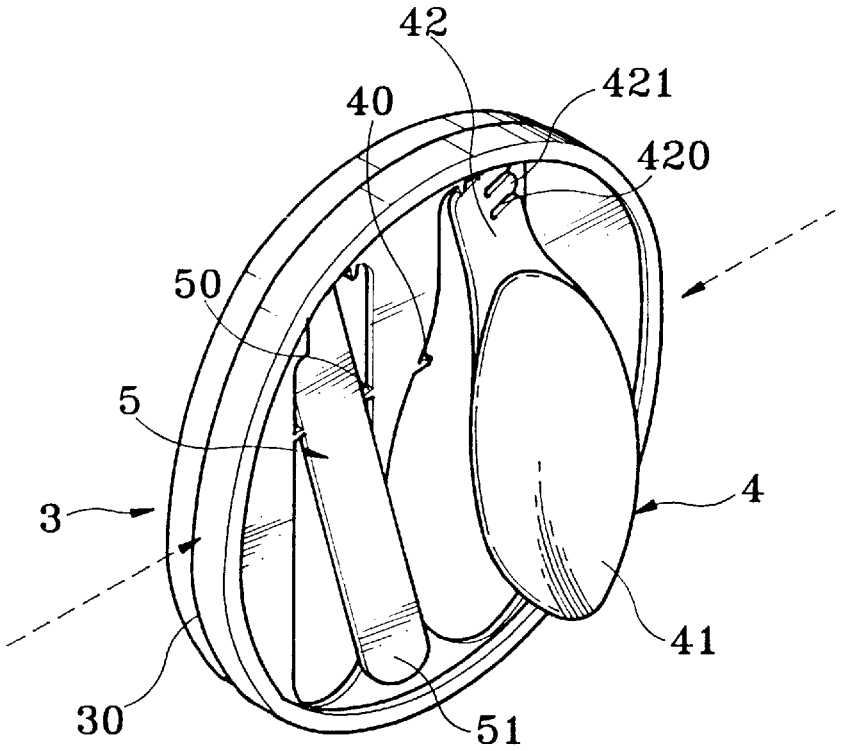
FIG. 3A shows the cover radially squeezed according to the present invention.
Figure 3B:
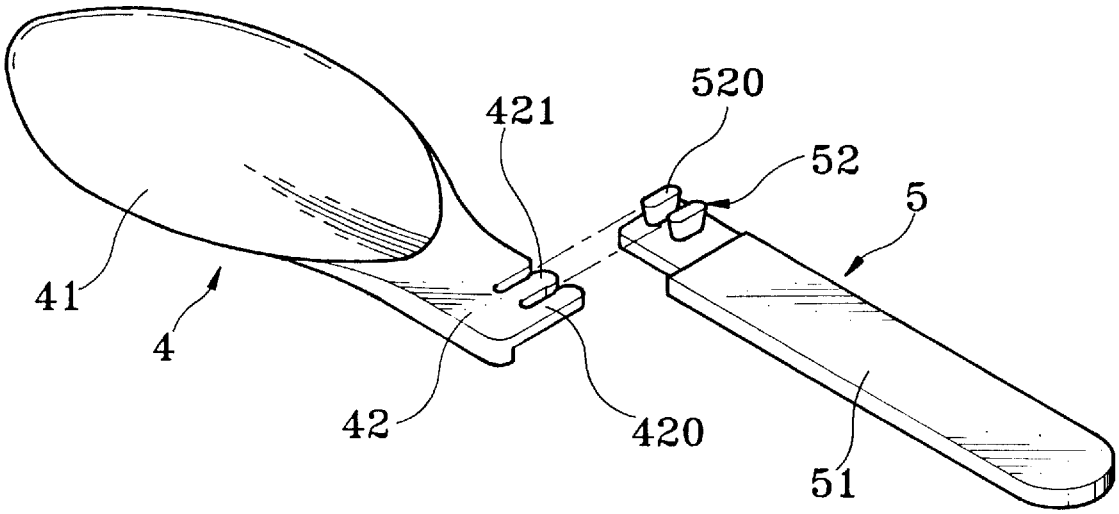
FIG. 3B shows the spoon bowl and the spoon handle respectively detached from the cover according to the present invention.

Referring to FIG. 3B and FIG. 1 again, the aforesaid cover body 3, spoon bowl 4 and spoon handle 5 are injection-molded from same plastic material. When the cover body 3, the spoon bowl 4 and the spoon handle 5 are injection-molded, the connecting points 40;50 are formed between the cover body 3 and the borders of the spoon bowl 4 and spoon handle 5. This integral design is suitable for a mass production to lower the manufacturing cost. The spoon bowl 4 comprises a bowl body 41 and a coupling neck 42 extended from one end of the bowl body 41. The coupling neck 42 comprises a plurality of elongated notches 420 extending sideways, and a plurality of fingers 421 separated by the elongated notches 420. The spoon handle 5 comprises a handle body 51 for the holding by the hand, a coupling neck 52 adapted for coupling to the coupling neck 42 of the spoon bowl 4. The coupling neck 52 has a plurality of upright coupling rods 520 raised from one side and adapted to be transversely forced into the elongated notches 420 of the coupling neck 42 of the spoon bowl 4. The transverse width of the upright coupling rods 520 gradually increases from the foot toward the top end, so that the coupling neck 52 of the spoon handle 5 does not easily disconnect from the coupling neck 42 of the spoon bowl 4 after the engagement of the upright coupling rods 520 with the fingers 421.

The aforesaid sealing film 6 contracts when hot. After the molding of the cover body 3, the spoon bowl 4 and the spoon handle 5 are integrally formed in the cover body 3, then the sealing film 6 is sealed by a sealing machine on the top side of the cover body 3, i.e., the sealing film 6 is disposed on the outside to protect the spoon bowl 4 and the spoon handle 5 against contamination when the cover body 3 is covered on the canned food 3. When sealed, the canned food 3 is sterilized by heat, and the sealing film 6 is stretched tight when heating (because it contracts when hot). Because the cover body 3 is directly packed on the canned food 2 by a packing machine and the sealing film 6 is directly sealed on the cover body 3 by a sealing machine, workmen have no change to touch the spoon bowl 4 and the spoon handle 5 during the packing procedure.

Figure 4:
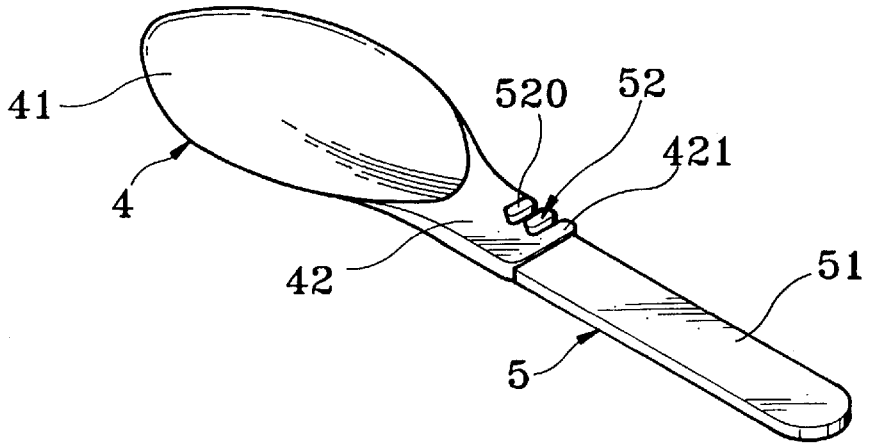
FIG. 4 is an assembly view of FIG. 3B.

Referring to FIGS. 3A, 3B and 4, when in use, the cover body 3 is removed from the canned food 2 (see FIG. 2) or cupped food 9 (see FIG. 6), then the cover body 3 is squeezed by hand in direction indicated by the arrowheads shown in FIG. 3A. When the cover body 3 is squeezed radially, the spoon bowl 4 and the spoon handle 5 are forced to spring out, and the user can then tear up the connecting points 40;50 and separate the spoon bowl 4 and the spoon handle 5 from the cover body 3. When detached, the coupling neck 52 of the spoon handle 5 is coupled to the coupling neck 42 of the spoon bowl 4 by forcing the upright coupling rods 520 into the notches 420 horizontally (see FIGS. 3B and 4). When the spoon bowl 4 and the spoon handle 5 are detached from the cover body 3, the sealing film 6 is still maintained intact. If the canned food 2 or cupped food 9 is not eaten up, the cover body 3 is covered on the canned food 2 or cupped food 9 again for preservation.

Figure 5:
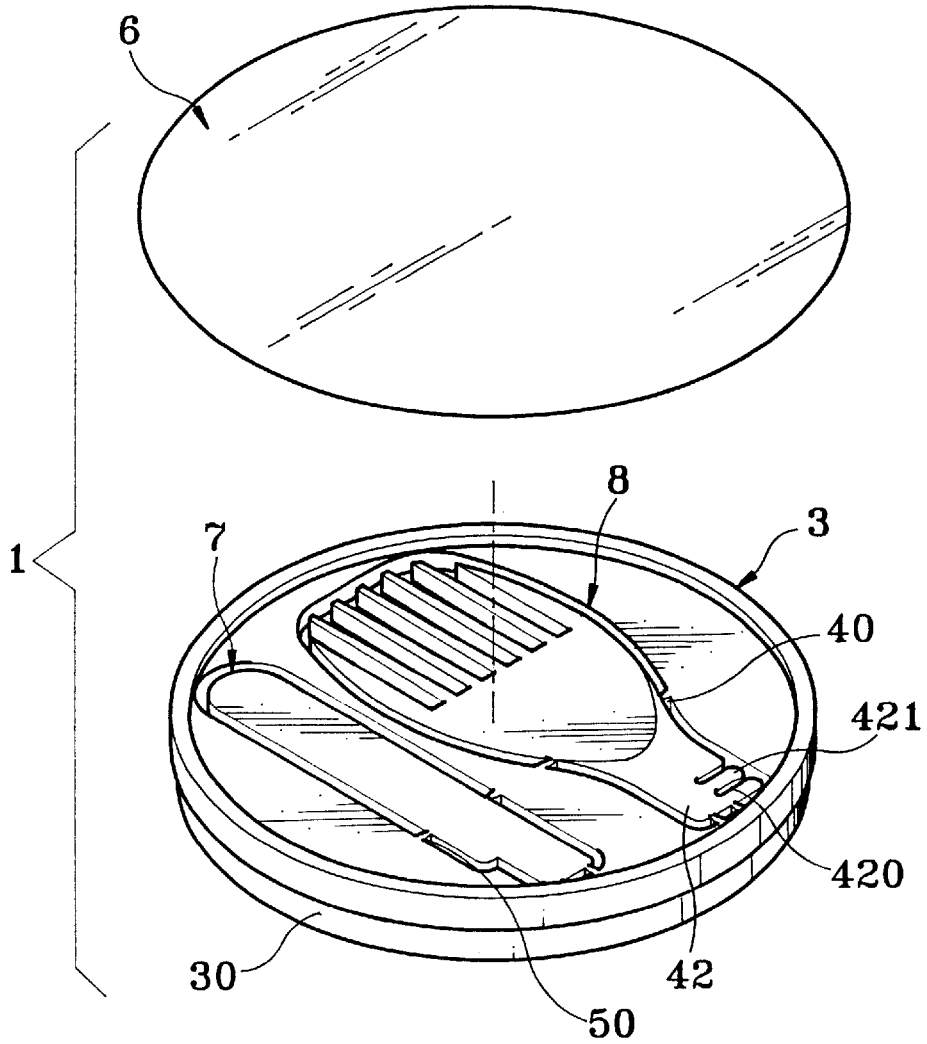
FIG. 5 shows an exploded view of an alternate form of the present invention.

FIG. 5 shows an alternate form of the present invention in which a fork body 8 and a fork handle 7 are integrally formed in the cover body 3.

I claim:

1. A cover for a food container comprising:

a cover body configured to cover an end of a food container;

a kitchen utensil integrally formed in said cover body and releasably connected thereto by a plurality of discrete, spaced apart frangible connecting elements, said kitchen utensil comprises a spoon bowl and a spoon handle separately formed in said cover body and adapted for connecting to each other; and wherein said spoon bowl comprises a bowl body and a coupling neck extending from one end of said bowl body, the coupling neck of said spoon bowl comprising a plurality of elongated transverse notches and a plurality of fingers separated by said elongated transverse notches, said spoon handle comprising a handle body and a coupling neck at one end of said handle body, the coupling neck of said spoon handle comprising a plurality of upright coupling rods extending from one side and adapted to be transversely forced into the elongated notches of the coupling neck of said spoon bowl to engage with said fingers.

* * * * *